US008540534B2

(12) United States Patent
Sato et al.

(10) Patent No.: US 8,540,534 B2
(45) Date of Patent: Sep. 24, 2013

(54) CONNECTOR

(75) Inventors: Yuzo Sato, Tokyo (JP); Hiroaki Obikane, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/253,236

(22) Filed: Oct. 5, 2011

(65) Prior Publication Data

US 2012/0094544 A1 Apr. 19, 2012

(30) Foreign Application Priority Data

Oct. 19, 2010 (JP) ..... 2010-234908

(51) Int. Cl.
*H01R 24/28* (2011.01)
*H01R 12/00* (2006.01)

(52) U.S. Cl.
USPC ..... 439/660; 439/74

(58) Field of Classification Search
USPC ..... 439/74, 83, 660
See application file for complete search history.

(56) References Cited

U.S. PATENT DOCUMENTS 6,010,370 A * 1/2000 Aihara et al. ..... 439/660
6,905,345 B2 * 6/2005 Zhang ..... 439/74
7,172,433 B2 * 2/2007 Tsai ..... 439/660
7,320,606 B2 * 1/2008 Midorikawa ..... 439/74
7,674,115 B2 3/2010 Midorikawa
7,748,993 B2 7/2010 Midorikawa et al.
2009/0221157 A1 9/2009 Midorikawa et al.

FOREIGN PATENT DOCUMENTS

JP 4454651 B2 2/2009

OTHER PUBLICATIONS

Finnish Office Action dated Jan. 30, 2013 (and English translation thereof) in counterpart Finnish patent Application No. 20116032.

* cited by examiner

*Primary Examiner* — Briggitte R Hammond
(74) *Attorney, Agent, or Firm* — Holtz, Holtz, Goodman & Chick, PC

(57) ABSTRACT

A connector having a housing and terminals, mates with a mating connector having mating terminals. The housing has a side wall, a facing wall and a receiving depression between the side wall and the facing wall. Each terminal is installed in the receiving depression and has an attached portion attached to the housing, a first spring portion extending from the attached portion, an upward-extending portion extending from the first spring portion, an elastic support portion extending from the upward-extending portion, and a contact portion supported by the elastic support portion. The upward-extending portion has an abutting portion opposite the facing wall. The elastic support portion is bendable more easily than a spring formed with the first spring portion and the upward-extending portion. The contact portion contacts the mating terminal when the connector is mated with the mating connector and the abutting portion is pressed against the facing wall.

12 Claims, 6 Drawing Sheets

CONNECTOR

CROSS REFERENCE TO RELATED APPLICATIONS

Applicants claim priority under 35 U.S.C. §119 of Japanese Patent Application No. JP2010-234908 filed Oct. 19, 2010.

BACKGROUND OF THE INVENTION

This invention relates to a connector which is configured to be mounted on a circuit board and is configured to be mated with a mating connector.

For example, a connector of this type is disclosed in JP-B2 4454651, contents of which are incorporated herein by reference. The connector of JP-B2 4454651 has a housing and a terminal installed in the housing. The terminal is prevented from being damaged when the mating connector mated with the connector is removed from the connector. Especially, according to a second embodiment disclosed in JP-B2 4454651, the terminal of the connector has an elastic portion shaped in a U-like shape (see FIGS. 6 and 7 of JP-B2 4454651). The elastic portion has a bottom arm, an upper-extending arm and a middle portion formed between the bottom arm and the upper-extending arm. The middle portion has a curved portion and an engaging protrusion formed on the curved portion. The engaging protrusion protrudes from the curved portion toward a lower end of a facing wall of the housing. The engaging protrusion is engaged with the facing wall when the mating connector is removed from the connector so that the terminal is prevented from being damaged.

The connector of JP-B2 4454651 is formed with a gap between the engaging protrusion and the facing wall under an unmated state where the connector is not mated with the mating connector. When the mating connector is removed, the engaging protrusion moves to the facing wall over the gap so that the engaging protrusion is engaged with the facing wall of the housing. However, the middle portion which is formed with the engaging protrusion is essentially difficult to be moved. Therefore, it is necessary to shorten the gap as possible.

However, it is impossible to avoid a variation within a tolerance when an actual product is produced. If the gap under the unmated state is designed to have a too small tolerance, the engaging protrusion might obstruct the terminal to be attached to the housing so that the terminal is unable to be installed into the housing.

On the other hand, if the gap is designed to have a relatively large tolerance, the engaging protrusion might not be engaged with the facing wall when the mating connector is removed from the connector. Even if the engaging protrusion is engaged with the facing wall, a position at which the engaging protrusion is engaged with the facing wall might be upper than a preferable position so that the terminal is damaged.

SUMMARY OF THE INVENTION

It is therefore an object of the present invention to provide a connector configured to be mated with and removed from a mating connector. The connector comprises a housing and a terminal. The terminal of the connector is able to be installed into the housing easily and securely. Moreover, the terminal is prevented from being damaged when a mating connector is removed from the connector.

One aspect of the present invention provides a connector matable with a mating connector having a plurality of mating terminals. The connector comprises a housing and a plurality of terminals. The housing has a side wall, a facing wall and a receiving depression. The side wall is an external wall of the housing and extends in a first direction. The facing wall is formed so as to face the side wall in a second direction perpendicular to the first direction. The receiving depression is formed between the side wall and the facing wall in the second so as to be depressed downward. The terminals is arranged in the first direction so as to be held by the housing. Each of the terminals has an attached portion, a first spring portion, an upward-extending portion, an elastic support portion and a contact portion. The attached portion is attached to the housing. The first spring portion is formed between the attached portion and the upward-extending portion so as to extend within the receiving depression. The upward-extending portion extends upward from the first spring portion. The elastic support portion further extends upward from the upward-extending portion. The contact portion is supported by the elastic support portion. The upward-extending portion has an abutting portion formed at a boundary between the upward-extending portion and the elastic support portion. The abutting portion is opposite to the facing wall. The elastic support portion is formed so as to be bent more easily than a spring formed with the first spring portion and the upward-extending portion. The contact portion is brought into contact with the mating terminal under a mated state where the connector is mated with the mating connector so that the abutting portion is pressed against the facing wall.

An appreciation of the objectives of the present invention and a more complete understanding of its structure may be had by studying the following description of the preferred embodiment and by referring to the accompanying drawings.

Figure 1:
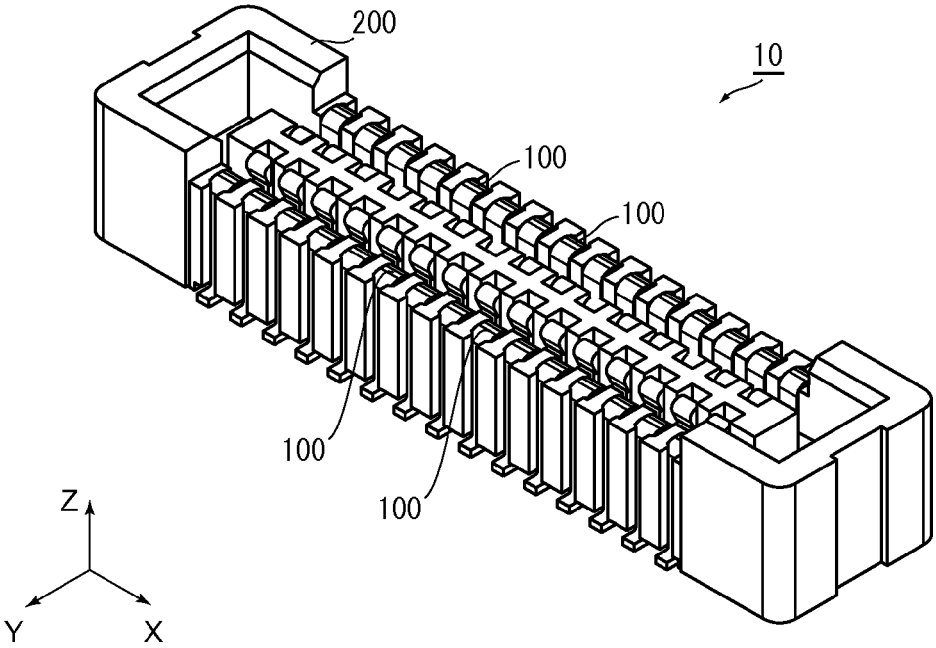
FIG. 1 is a perspective view showing a connector according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 6:
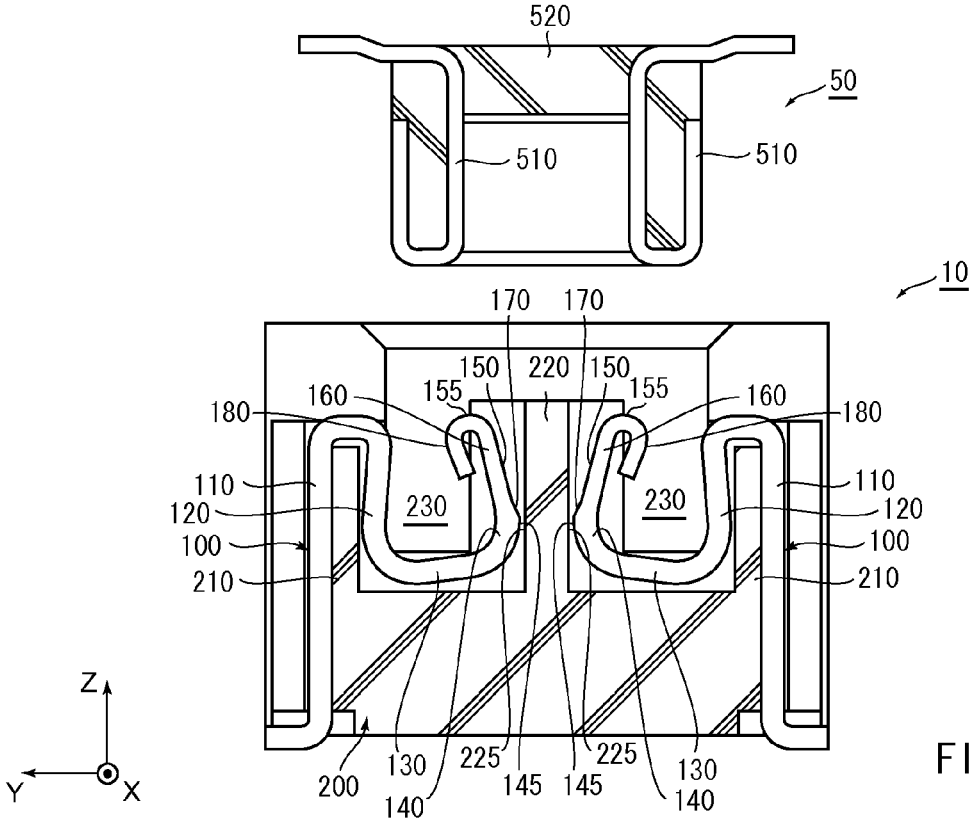
FIG. 6 is a cross-sectional view showing the connector of FIG. 1 and a mating connector, wherein the connector and the mating connector are under an unmated state.
Figure 7:
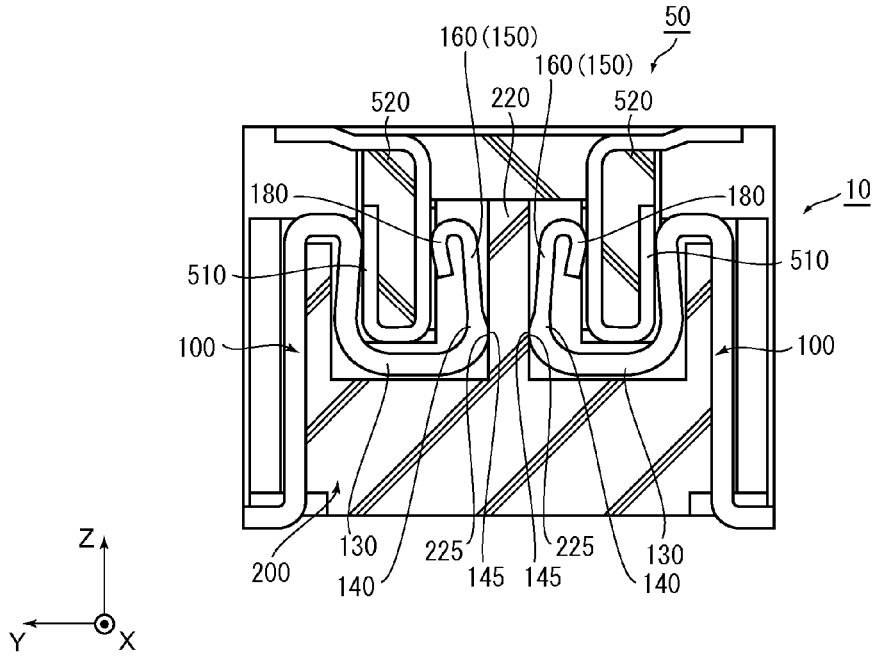
FIG. 7 is a cross-sectional view showing the connector of FIG. 1 and the mating connector, wherein the connector and the mating connector are under a mated state.

As shown in FIGS. 1, 6 and 7, a connector 10 according to an embodiment of the present invention is a receptacle connector which is configured to be mounted on and fixed to a circuit board (not shown). On the other hand, a mating connector 50 according to the present embodiment is a plug connector which is configured to be mounted on and fixed to a mating circuit board (not shown). The mating connector 50 has a mating housing 520 and a plurality of mating terminals 510 held by the mating housing 520. The connector 10 is matable with the mating connector 50. In other words, the connector 10 forms a board-to-board connector assembly together with the mating connector 50.

As shown in FIGS. 1, 6 and 7, the connector 10 comprises a housing 200 and a plurality of terminals 100. The housing 200 extends long in the X-direction (first direction). The terminals 100 are arranged in the X-direction (first direction) so as to be held by the housing 200.

Figure 2:
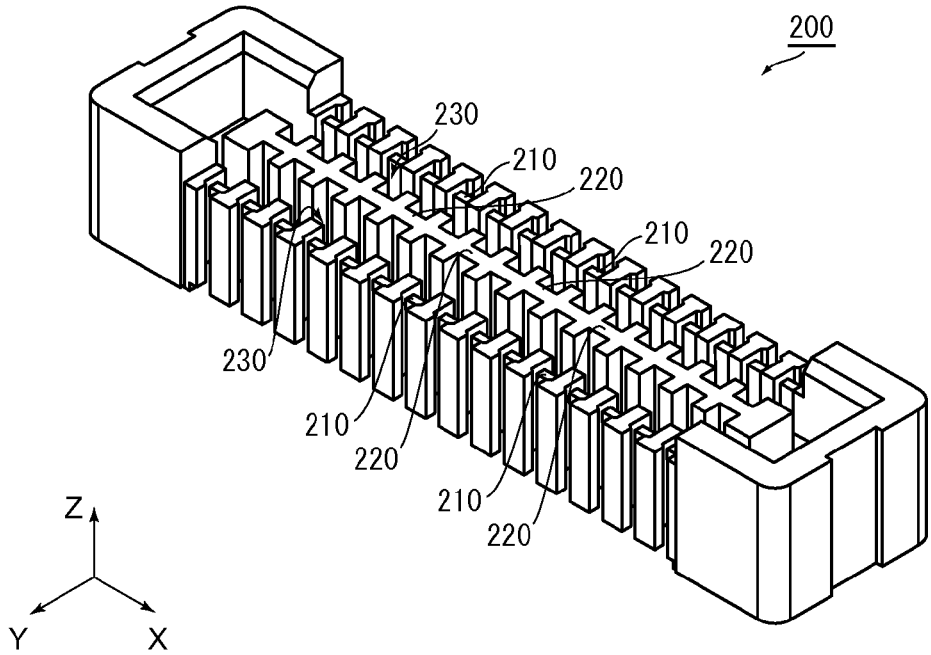
FIG. 2 is a perspective view showing a housing of the connector of FIG. 1.

As shown in FIGS. 2, 6 and 7, the housing 200 has two opposite attached walls (side walls) 210 in the Y-direction (second direction), a facing wall 220 and receiving depressions 230. Each of the attached wall 210 is an external wall of the housing 200 and extends in the X-direction (first direction). The facing wall 220 is formed so as to face the attached walls 210 in the Y-direction (second direction). In other words, the facing wall 220 is located between the attached walls 210 in the Y-direction. More specifically, the facing wall 220 is formed on a middle part of the housing 200 in the Y-direction so as to be apart from the attached walls 210 in the Y-direction. The facing wall 220 rises along the positive Z-direction. The facing wall 220 is provided with an abutment portion 225 formed on a middle portion thereof in the Z-direction. As described later, the abutment portion 225 is configured so that a part of the terminal 100 is brought into abutment with the abutment portion 225. In other words, the abutment portion 225 is configured to be pressed by a part of the terminal 100 under a mated state where the connector 10 is mated with the mating connector 50. The receiving depressions 230 are formed between the respective attached walls 210 and the facing wall 220 in the Y-direction (second direction) so as to be depressed downward (i.e. along the negative Z-direction).

Figure 3:
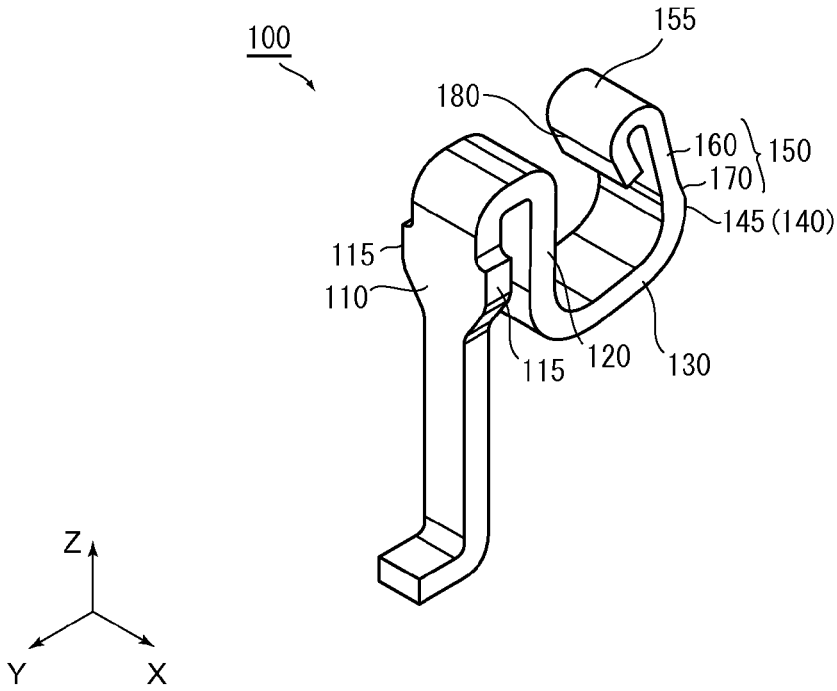
FIG. 3 is a perspective view showing a terminal of the connector of FIG. 1.
Figure 4:
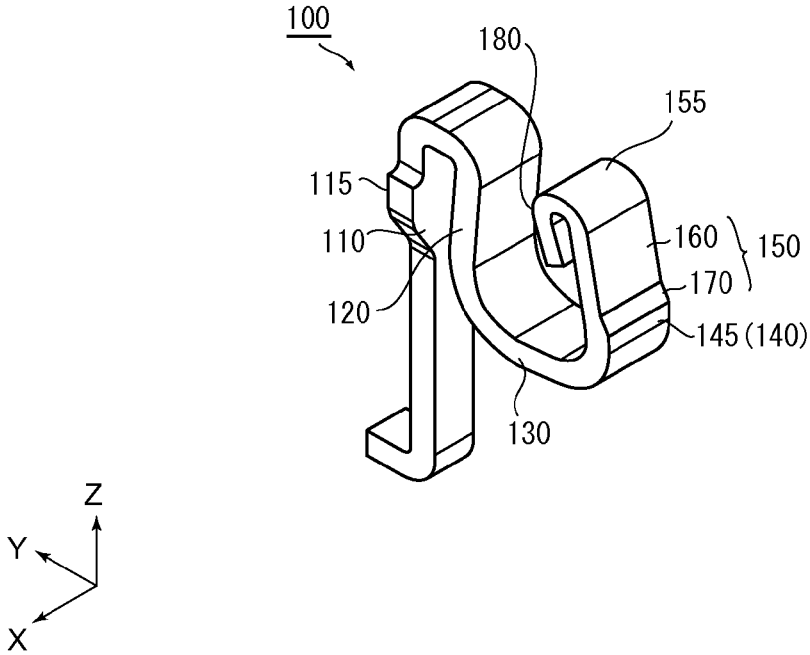
FIG. 4 is another perspective view showing the terminal of FIG. 3, as seen along a different direction of FIG. 3.

As shown in FIGS. 3, 4, 6 and 7, each of the terminals 100 has an attached portion 110, a downward-extending portion 120, a bottom portion (first spring portion) 130, an upward-extending portion 140, an elastic support portion 150 and a contact portion 180. The aforementioned portions for each of the terminals 100 are formed by bending a common metallic material. The attached portion 110 is attached to the attached wall 210 of the housing 200. The downward-extending portion 120 extends downward (i.e. along the negative Z-direction) from the attached portion 110 within the receiving depression 230. The bottom portion 130 is formed between the attached portion 110 and the upward-extending portion 140 so as to extend within the receiving depression 230. According to the present embodiment, the bottom portion 130 extends from the downward-extending portion 120 to the upward-extending portion 140. The upward-extending portion 140 extends upward (i.e. along the positive Z-direction) from the bottom portion 130. The elastic support portion 150 further extends upward (i.e. along the positive Z-direction) from the upward-extending portion 140. The contact portion 180 is supported by the elastic support portion 150. As shown in FIGS. 3 and 4, the attached portion 110 is formed with opposite press-fitted portions 115 protruding in the X-direction. The press-fitted portions 115 are engaged with an inside surface of the attached wall 210 when the attached portion 110 is press-fitted into the attached wall 210 so that the terminal 100 is attached to the attached wall 210 of the housing 200. As can be seen from FIGS. 3 and 4, the bottom portion 130 connects a lower end (first lower end) of the downward-extending portion 120 with a lower end (second lower end) of the upward-extending portion 140 in a state that the first lower end and the second lower end are apart from each other in the Y-direction. A combination of the downward-extending portion 120, bottom portion 130 and the upward-extending portion 140 has a J-like shape, as seen along the X-direction.

The upward-extending portion 140 has an abutting portion 145 formed at a boundary between the upward-extending portion 140 and the elastic support portion 150. The abutting portion 145 is opposite to the abutment portion 225 of the facing wall 220. As can be seen from FIG. 7, the contact portion 180 is brought into contact with the mating terminal 510 under the mated state where the connector 10 is mated with the mating connector 50 so that the abutting portion 145 is pressed against the abutment portion 225 of the facing wall 220. As shown in FIG. 6, the abutting portion 145 according to the present embodiment is apart from the facing wall 220 under an unmated state where the connector 10 is not mated with the mating connector 50.

The elastic support portion 150 according to the present embodiment has a thin elastic portion 160 and a connecting portion 170. The thin elastic portion 160 is thinner than the upward-extending portion 140. In detail, each of the thin elastic portion 160 and the upward-extending portion 140 is shaped to have a uniform thickness. The thickness of the thin elastic portion 160 is smaller than the thickness of the upward-extending portion 140. The connecting portion 170 connects the upward-extending portion 140 and the thin elastic portion 160 with each other.

The abutting portion 145 is located at an upper end of the upward-extending portion 140 so that the abutting portion 145 is able to be moved relatively easily than other parts of the upward-extending portion 140 under the mated state. Furthermore, the thin elastic portion 160 is thinner than the upward-extending portion 140 so that the thin elastic portion 160 is more elastically-flexible than the upward-extending portion 140. More specifically, the elastic support portion 150 is formed so as to be bent more easily than a spring formed with the bottom portion 130 and the upward-extending portion 140. The contact portion 180 is mainly supported elastically by the thin elastic portion 160 of the elastic support portion 150 when the abutting portion 145 is pressed against the facing wall 220 under the mated state. Under the mated state, a movement of the contact portion 180 is mainly caused by an elastic deformation of the thin elastic portion 160 of the elastic support portion 150. On the other hand, the upward-extending portion 140 is hardly moved when the contact portion 180 is moved. According to the present embodiment, a pressed state of the abutting portion 145 where the abutting portion 145 is pressed against the facing wall 220 is maintained even when the mating connector 50 is removed from the connector 10.

The connecting portion 170 according to the present embodiment has a first end which borders the upward-extending portion 140 and a second end which borders the thin elastic portion 160. The connecting portion 170 becomes thinner gradually from the first end toward the second end. In other word, the connecting portion 170 is formed to be tapered. According to the present embodiment, the tapered-shape of the connecting portion 170 makes it possible to avoid a stress concentration to a boundary between the upward-extending portion 140 and the elastic support portion 150.

Figure 5:
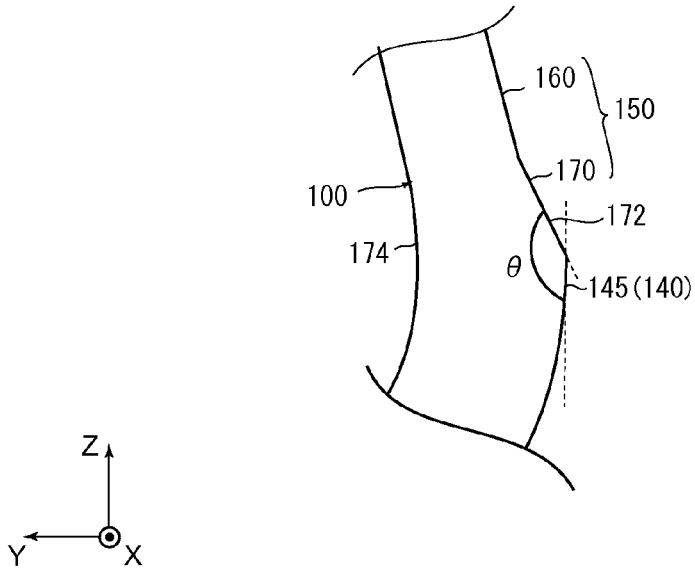
FIG. 5 is a schematic view showing a part of the terminal of FIG. 3.

As shown in FIG. 5, the connecting portion 170 according to the present embodiment has a tapered surface 172 formed on a front-side thereof and a back surface 174 formed on a backside thereof. The tapered surface 172 faces the facing wall 220. The tapered surface 172 extends from the first end of the connecting portion 170 to the second end of the connecting portion 170 so as to recede from the facing wall 220 gradually. The back surface 174 is formed so as to extend linearly together with a backside surface of the thin elastic portion 160. As can be seen from FIGS. 5 and 7, the aforementioned structure of the connecting portion 170 makes it possible to widen a gap between the thin elastic portion 160 and the facing wall 220 as compared with a case that the terminal 100 has a uniform thickness. According to the present embodiment, it is possible to allow the thin elastic portion 160 to be elastically deformed in a wide range as compared with the case that the terminal 100 has the uniform thickness. According to the present embodiment, the pressed state of the abutting portion 145 against the facing wall 220 may be maintained more securely.

Referring to FIG. 5, the upward-extending portion 140 has an upward-extending surface (i.e. the abutting portion 145) facing the facing wall 220 while the connecting portion 170 has the tapered surface 172 facing the facing wall 220. The upward-extending surface and the tapered surface 172 meet each other at a meeting point as seen along the X-direction. It is possible to draw a first tangent line at a point which is located on the upward-extending surface and is nearest to the meeting point. Similarly, it is possible to draw a second tangent line at a point which is located on the tapered surface 172 and is nearest to the meeting point. The first tangent line and the second tangent line make an angle θ (theta). According to the present embodiment, It is preferable that the angle θ is not less than 120 degrees and not more than 150 degrees. In other words, it is preferable that the upward-extending surface and the tapered surface 172 make an angle from 120 degrees to 150 degrees. The stress concentration to the boundary between the upward-extending portion 140 and the elastic support portion 150 might occur if the angle θ is less than 120 degrees. On the other hand, the tapered surface 172 of the connecting portion 170 might become longer so that the elastic support portion 150 gets too close to the facing wall 220 if the angle θ is more than 150 degrees. If the elastic support portion 150 is too close to the facing wall 220, a range within which the elastic support portion 150 is able to be deformed may be too narrow.

As shown in FIG. 6, the elastic support portion 150 has an upper end 155 in the Z-direction. The contact portion 180 according to the present embodiment extends from the upper end 155 of the elastic support portion 150 toward the downward-extending portion 120 (i.e. toward the side wall 210) while extending toward the bottom portion 130. As shown in FIG. 7, the contact portion 180 is designed to be brought into contact with the mating terminal 510 under the mated state of the connector 10 with the mating connector 50.

The terminal 100 according to the present embodiment is made of a metallic intermediate member having an uniform thickness. The metallic intermediate member is pressed partially so that the pressed parts become thinner than the other parts. In other words, the pressed metallic intermediate member (pressed member) is formed with thin parts and thick parts. The terminal 100 is formed by bending the pressed member. According to the present embodiment, the pressed member is formed with a boundary portion between the thick part and the thin part. The boundary portion is not shaped as a sharp drop but a tapered portion which becomes thinner gradually from the thick part to the thin part. The connecting portion 170 of the elastic support portion 150 is made from the boundary portion of the pressed member. The attached portion 110, the downward-extending portion 120, the bottom portion 130 and the upward-extending portion 140 are formed by bending the thick parts. The thin elastic portion 160 of the elastic support portion 150 and the contact portion 180 are formed by bending the thin parts. As can be seen from the aforementioned description, the attached portion 110, the downward-extending portion 120, the bottom portion 130 and the upward-extending portion 140 have the same thickness as one another. Similarly, the thin elastic portion 160 and the contact portion 180 have the same thickness as each other.

As can be seen from FIG. 1, the facing wall 220 of the connector 10 has overlapped portions each of which is overlapped with the terminal 100 as seen along the Y-direction. As shown in FIGS. 6 and 7, the overlapped portion of the facing wall 220 according to the present embodiment has a uniform thickness in a cross-section which is parallel to the YZ-plane. However, various modifications are possible with respect to the facing wall 220.

Figure 8:
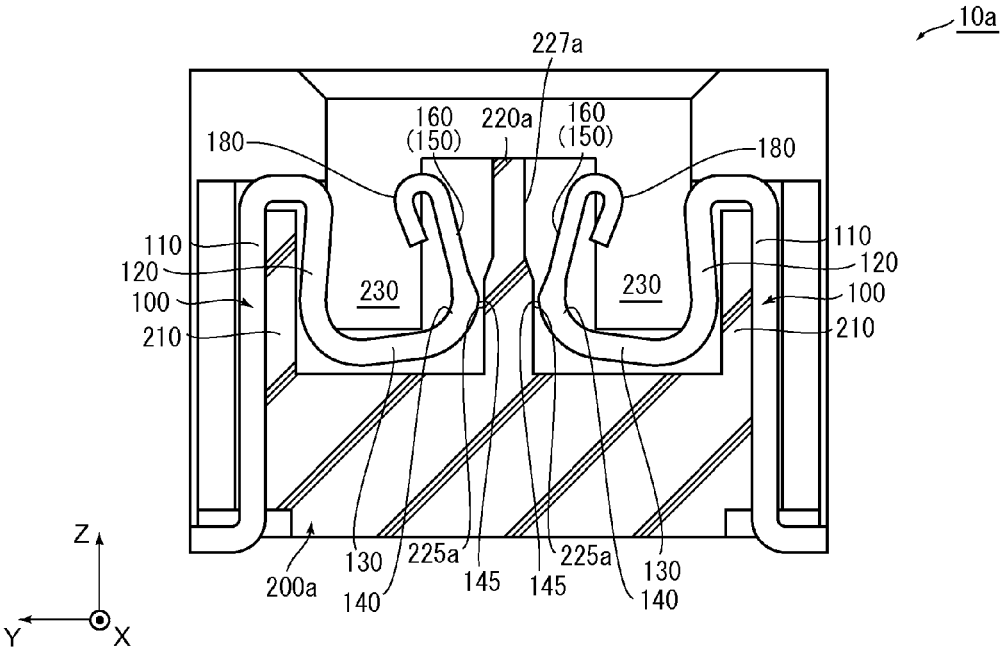
FIG. 8 is a cross-sectional view showing a modification of the connector of FIG. 6.

As shown in FIG. 8, a connector 10*a* according to a modification comprises the terminals 100 and a housing 200*a* formed with a facing wall 220*a*. The facing wall 220*a* is provided with an abutment portion 225*a* and a thin portion 227*a*. The abutment portion 225*a* is configured to be pressed by the abutting portion 145 under the mated state of the connector 10*a* with the mating connector 50. The thin portion 227*a* is located upper than the abutment portion 225*a*. The thin portion 227*a* faces the contact portion 180 of the terminal 100 in the Y-direction (second direction). The thin portion 227*a* is formed to be thinner than the abutment portion 225*a*. In detail, the thin portion 227*a* recesses in the Y-direction so as to withdraw from the contact portion 180. The recess of the thin portion 227*a* contributes to widen a region within which the contact portion 180 is movable (i.e. the region within which the elastic support portion 150 is elastically deformable). The thin portion 227*a* is able to be omitted so that the facing wall 220 is formed only with the abutment portion 225*a* if the housing 200 has enough strength without the thin portion 227*a*.

The elastic support portion 150 of the terminal 100 of the connector 10 according to the previously described embodiment has the thin elastic portion 160 which is formed to be thinner than the upward-extending portion 140 so as to realize the elastically-flexible spring. However, various modifications are possible with respect to the spring of the terminal 100.

Figure 9:
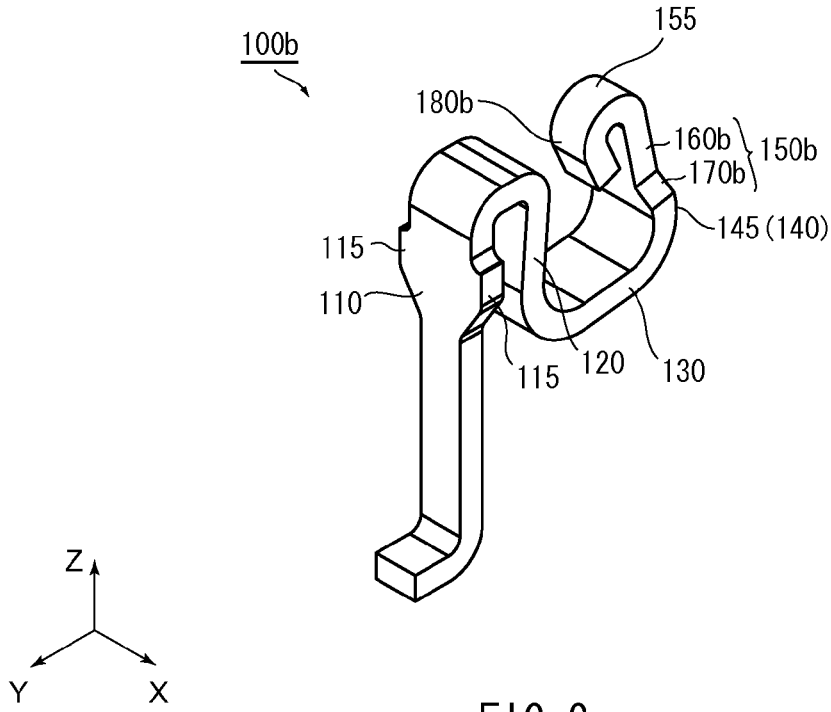
FIG. 9 is a perspective view showing a modification of the terminal of FIG. 3.
Figure 10:
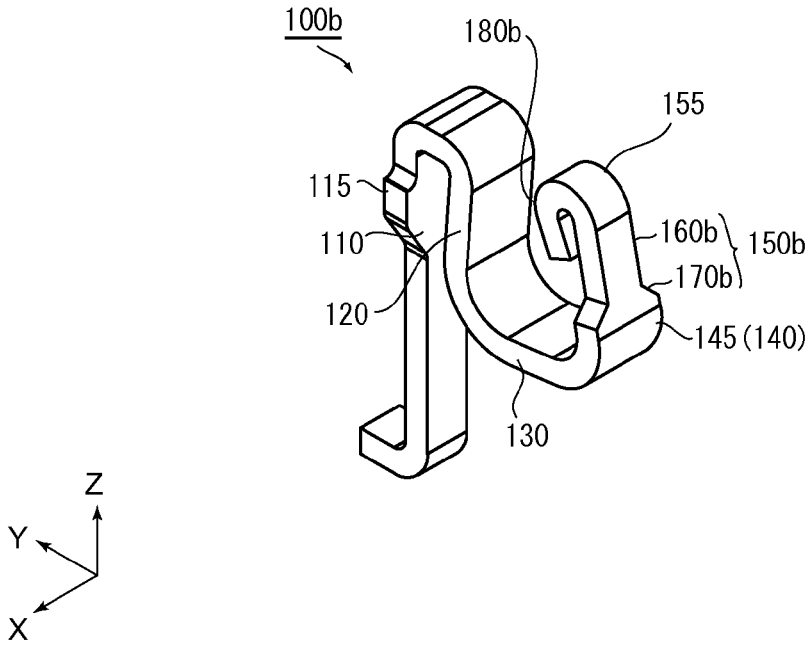
FIG. 10 is another perspective view showing the terminal of FIG. 9, as seen along a different direction of FIG. 9.

As shown in FIGS. 9 and 10, a terminal 100*b* according to another modification is formed by bending a metallic intermediate member having a uniform thickness. The terminal 100*b* is formed with an elastic support portion 150*b* and a contact portion 180*b*. The elastic support portion 150*b* and the contact portion 180*b* have different structures than the elastic support portion 150 and the contact portion 180 of the terminal 100, respectively. In detail, the elastic support portion 150*b* has a narrow portion 160*b* and a connecting portion 170*b*. The narrow portion 160*b* is narrower than the upward-extending portion 140 in the X-direction (first direction). In other words, the elastic support portion 150*b* has a portion (narrow portion 160*b*) which is formed to be narrower than the upward-extending portion 140 in the X-direction. The connecting portion 170*b* connects the upward-extending portion 140 with the narrow portion 160*b*. According to the present modification, the contact portion 180*b* and the narrow portion 160*b* has a same width so that the contact portion 180 is also narrower than the upward-extending portion 140. The narrow portion 160*b* according to the present modification has a small width as compared with the upward-extending portion 140 so that the narrow portion 160*b* is more elastically-flexible than the upward-extending portion 140. However, the thin elastic portion 160 according to the previously described embodiment is more elastically-flexible than the narrow portion 160*b*. Therefore, the previously described embodiment is more preferable than the present modification. It is possible to combine the present modification with the previously described embodiment. Specifically, the thin elastic portion 160 may be formed to be narrower than the upward-extending portion 140 in the X-direction. Moreover, it is possible to combine the present modification with the previously described modification. Specifically, the terminal 100*b* having the narrow portion 160*b* may be installed into the housing 200*a* formed with the facing wall 220*a* having the thin portion 227*a*.

The terminal 100 of the connector 10 according to the previously described embodiment has the attached portion 110 and the downward-extending portion 120. However, various modifications are possible with respect to the installation of the terminal 100.

Figure 11:
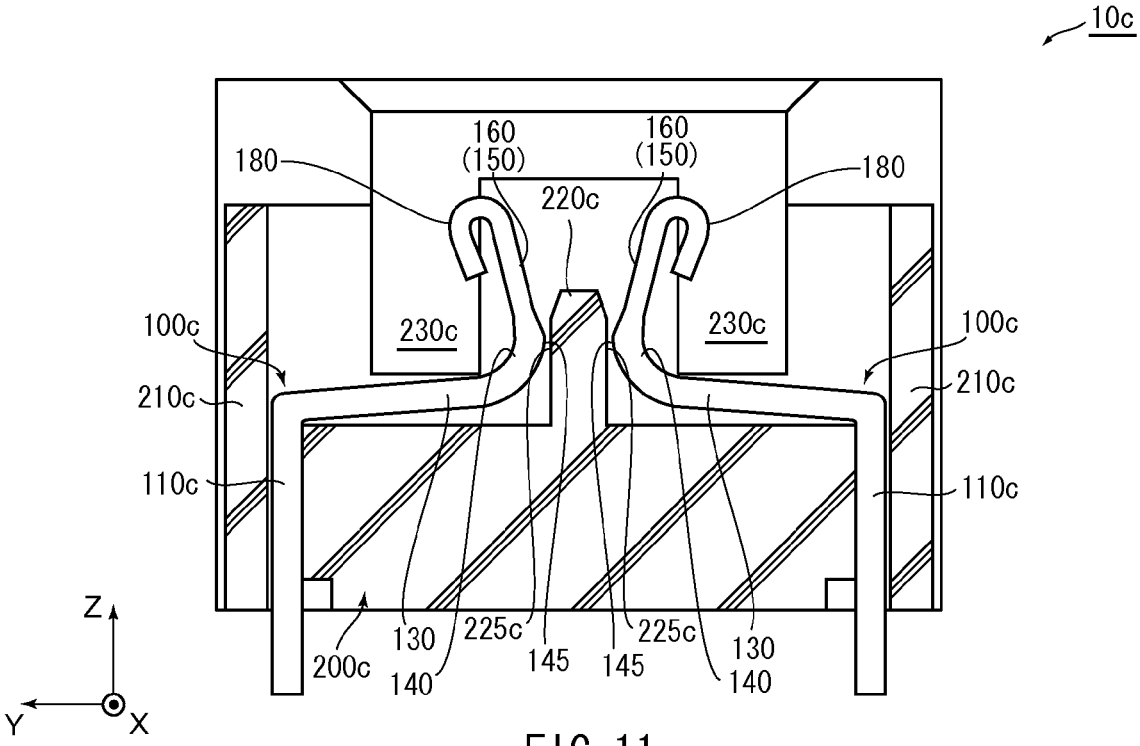
FIG. 11 is a cross-sectional view showing another modification of the connector of FIG. 6.

As shown in FIG. 11, a connector 10*c* according to another modification comprises a plurality of terminals 100*c* and a housing 200*c*. The housing 200*c* has side walls 210*c* formed on opposite ends thereof in the Y-direction. Each of the side walls 210*c* is located at the outside of the housing 200*c* in the Y-direction while each of the terminals 100*c* is located at the inside of the housing 200*c* in the Y-direction. The housing 200*c* further has a facing wall 220*c* which faces each of the side walls 210*c* in the Y-direction. The facing wall 220*c* is lower than the side wall 210*c*. In other words, the facing wall 220*c* is smaller than the side wall 210*c* in the Z-direction. The facing wall 220*c* has an abutment portion 225*c* and a trapezoid portion formed on upside of the abutment portion 225*c*. The trapezoid portion has a trapezoid-like cross-section as seen along the X-direction. The trapezoid portion has an upper surface. The upper surface of the trapezoid portion is located below the contact portion 180 of the terminal 100*c*. Each of the side walls 210*c* is provided so as to be apart from the facing wall 220*c*. The housing 200*c* further has receiving depressions 230*c* which are formed between the respective side walls 210*c* and the facing wall 220*c*.

The illustrated terminal 100*c* of the connector 10*c* has an attached portion 110*c*, a first spring portion 130, an upward-extending portion 140, an elastic support portion 150 and a contact portion 180. The attached portion 110*c* is attached to and held by the housing 200*c* so as to protrude downward (i.e. along the negative Z-direction) from the housing 200*c*. The first spring portion 130 is formed between the attached portion 110*c* and the upward-extending portion 140 so as to extend within the receiving depression 230*c*. According to the present modification, the first spring portion 130 extends from the attached portion 110*c* to the upward-extending portion 140. The upward-extending portion 140 extends upward (i.e. along the positive Z-direction) from the first spring portion 130. The elastic support portion 150 further extends upward (i.e. along the positive Z-direction) from the upward-extending portion 140. The contact portion 180 is supported by the elastic support portion 150. The first spring portion 130 connects an upper end of the attached portion 110*c* with a lower end of the upward-extending portion 140 in a state that the upper end and the lower end are apart from each other in the Y-direction. According to the present modification, similar to the previously described embodiment, the contact portion 180 is mainly supported elastically by the elastic support portion 150 when the abutting portion 145 is pressed against the abutment portion 225*c* of the facing wall 220*c* under the mated state of the connector 10*c* with a mating connector (not shown). According to the present modification, a movement of the contact portion 180 is mainly caused by an elastic deformation of the elastic support portion 150. According to the present modification, similar to the previously described embodiment, a pressed state of the abutting portion 145 where the abutting portion 145 is pressed against the facing wall 220*c* is maintained securely. Thus, it is possible to prevent the terminal 100*c* to be removed from the housing 200*c* or damaged when the mating connector is removed from the connector 10*c*.

The present application is based on a Japanese patent application of JP2010-234908 filed before the Japan Patent Office on Oct. 19, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector matable with a mating connector having a plurality of mating terminals, the connector comprising:

a housing having a side wall, a facing wall and a receiving depression, the side wall being an external wall of the housing and extending in a first direction, the facing wall being formed so as to face the side wall in a second direction perpendicular to the first direction, the receiving depression being formed between the side wall and the facing wall in the second direction so as to be depressed downward; and a plurality of terminals arranged in the first direction so as to be held by the housing, each of the terminals having an attached portion, a first spring portion, an upward-extending portion, an elastic support portion and a contact portion, the attached portion being attached to the housing, the first spring portion being formed between the attached portion and the upward-extending portion so as to extend within the receiving depression, the upward-extending portion extending upward from the first spring portion, the elastic support portion further extending upward from the upward-extending portion, the contact portion being supported by the elastic support portion, the upward-extending portion having an abutting portion formed at a boundary between the upward-extending portion and the elastic support portion, the abutting portion being located above the first spring portion, the abutting portion being opposite to the facing wall, the elastic support portion being formed so as to be bent more easily than a spring formed with the first spring portion and the upward-extending portion, the contact portion being brought into contact with the mating terminal under a mated state where the connector is mated with the mating connector so that the abutting portion is pressed against the facing wall.

2. The connector as recited in claim 1, wherein each of the terminals further has a downward-extending portion, the downward-extending portion extending downward from the attached portion within the receiving depression, the first spring portion extending from the downward-extending portion.

3. The connector as recited in claim 1, wherein the abutting portion is apart from the facing wall under an unmated state where the connector is not mated with the mating connector.

4. The connector as recited in claim 1, wherein the elastic support portion has a thin elastic portion, the thin elastic portion being thinner than the upward-extending portion.

5. The connector as recited in claim 4, wherein the elastic support portion further has a connecting portion, the connecting portion connecting the upward-extending portion and the thin elastic portion with each other so that the connecting portion has a first end which borders the upward-extending portion and a second end which borders the thin elastic portion, the connecting portion becoming thinner gradually from the first end toward the second end.

6. The connector as recited in claim 5, wherein:

the upward-extending portion has an upward-extending surface facing the facing wall and the connecting portion has a tapered surface facing the facing wall; and the upward-extending surface and the tapered surface make an angle from 120 degrees to 150 degrees.

7. The connector as recited in claim 4, wherein:

the contact portion extends from an upper end of the elastic support portion toward the side wall while extending toward the first spring portion.

8. The connector as recited in claim 4, wherein:

the first spring portion and the upward-extending portion have a same thickness to each other.

9. The connector as recited in claim 1, wherein:

the elastic support portion has a portion which is formed to be narrower than the upward-extending portion in the first direction.

10. The connector as recited in claim 1, wherein:

the facing wall is provided with an abutment portion and a thin portion, the thin portion being located higher than the abutment portion, the abutment portion being configured to be pressed by the abutting portion under the mated state, the thin portion facing the contact portion in the second direction, the thin portion being formed to be thinner than the abutment portion.

11. A connector as recited in claim 1, wherein the first spring portion is deformed downward when the connector is mated with the mating connector so that the abutting portion is pressed against the facing wall.

12. A connector as recited in claim 1, wherein the abutting portion is pressed against the facing wall when the first spring portion is deformed downward.

* * * * *